United States Patent [19]

Wright

[11] Patent Number: 4,482,405

[45] Date of Patent: Nov. 13, 1984

[54] EXPLOSIVE MOLDING COMPOSITION AND METHOD FOR PREPARATION THEREOF

[76] Inventor: Sam B. Wright, Holston Ordnance, Kingsport, Tenn. 37660

[21] Appl. No.: 50,311

[22] Filed: Aug. 18, 1960

[51] Int. Cl.[3] ..... C06B 45/10

[52] U.S. Cl. ..... 149/19.3; 149/19.92; 149/92

[58] Field of Search ..... 149/19.92, 19.3, 92

[56] References Cited

U.S. PATENT DOCUMENTS

| | | | |
|---|---|---|---|
| 2,067,213 | 1/1937 | Snelling | 149/18 |
| 2,768,072 | 10/1956 | Stark | 264/3 R |
| 2,900,242 | 8/1959 | Williams | 149/22 |
| 2,965,466 | 12/1960 | Ball | 149/92 |
| 2,970,898 | 2/1961 | Fox | 149/40 |
| 3,000,308 | 9/1961 | Land | 149/19 |
| 3,027,283 | 3/1962 | Bice | 149/19 |
| 3,173,817 | 3/1965 | Wright | 149/92 |
| 3,296,041 | 1/1967 | Wright | 149/19.3 |
| 3,326,731 | 6/1967 | Noddin | 149/19.3 |
| 3,455,749 | 7/1969 | Gow | 149/19.3 |

OTHER PUBLICATIONS

Rose, "The Condensed Chemical Dictionary", 4th Ed., pp. 184, 247, 262, 388, 640–641, 647–648 and 677.

*Primary Examiner*—Edward A. Miller

*Attorney, Agent, or Firm*—Anthony T. Lane; Robert P. Gibson

[57] ABSTRACT

1. A method for the preparation of an explosive composition which comprises dispersing with mixing polytetrafluoroethylene resin together with a non-ionic wetting agent in sufficient water to make a substantially homogeneous dispersion containing about 55–65% polytetrafluoroethylene resin solids, adding with mixing the dispersion of said polytetrafluoroethylene resin to a water slurry of a solid explosive capable of being plastic bonded selected from the group consisting of 1,3-diamino-2,4,6-trinitrobenzene, cyclotrimethylenetrinitramine and cyclotetramethylenetetranitramine, slowly adding with agitation to the explosive slurry containing the polytetrafluoroethylene resin a coagulating water-miscible organic solvent selected from the group consisting of methyl alcohol, ethyl alcohol, n-propyl alcohol, isopropyl alcohol and mixtures thereof, and recovering a coagulated bonded explosive, said polytetrafluoroethylene resin amounting to from 2–10% by weight of the explosive composition.

6 Claims, No Drawings

EXPLOSIVE MOLDING COMPOSITION AND METHOD FOR PREPARATION THEREOF

The present invention relates to a novel explosive molding composition. More particularly, it relates to an explosive molding composition which contains explosives of the plastics-bonded family, otherwise known as PBX compositions.

Conventional plastics-bonded explosives include crystalline high explosives such as 1,3-diamino-2,4,6-trinitrobenzene (DATB), cyclotrimethylenetrinitramine (Cyclonite, RDX), cyclotetramethylenetetranitramine (Homocyclonite, HMX) and other similar compounds, including mixtures of the foregoing and mixtures of the foregoing with other crystalline explosives. Oftentimes incorporated in compositions containing these explosives in addition to the plastic binder are strength-reinforcing materials such as polyester fibers, metallic fines, and the like. These explosive compositions are known to have great power and brisance. Conventional methods of preparing such compositions include the coating of the crystalline explosive with a plastic-plasticizer mixture which is then deposited from a solution of a volatile solvent. The molding powder can then be molded, pressed, or extruded into the shapes or configurations desired. Plastics conventionally used for the coating operation are polystyrene, nitrocellulose, nylon, and other similar compounds which are ordinarily soluble in organic solvents.

Despite the generally good physical properties of such conventional explosive compositions, there has long been a need for a simpler product not subject to the objectionable features of high moisture retention, inability to withstand high temperatures, and lack of compactness, that is, a comparatively low density. These conventional compositions also require a plasticizer to be used in conjunction with the plastic binder or coating. The above-mentioned plastic binders, in addition to not substantially aiding in the correcting of any of these undesirable properties, also contribute very little, if any, explosive power or brisance to the composition. In addition, known processes of preparing these compositions have been perplexed with the difficult problems associated with incorporating the various plastics therein, for example, by the conventional "slurry" and "quench" methods.

It is accordingly an object of this invention to provide a novel explosive composition of high density, high compressive strength and high explosive power.

It is another object of this invention to provide a bonded explosive composition highly resistant to water absorption and high-temperature deterioration.

It is still another object of this invention to provide an explosive molding composition having incorporated therein a bonding agent which does not require a plasticizer.

It is further an object of this invention to provide an explosive molding composition wherein the binder serves also to increase the brisance of the composition.

It is still further an object of this invention to provide a method for the preparation of highly stable, high-temperature resistant explosive molding compositions of high density.

Other objects of the invention will be apparent from the description and claims which follow.

I have found surprisingly that a PBX composition of high explosive power, increased density, and considerable stability against water absorption and high-temperature deterioration can be prepared by the incorporation therein of a small amount of polytetrafluoroethylene resin. Quite unexpectedly I have found that it is possible to incorporate the polytetrafluoroethylene resin in the PBX composition of this invention by first slurrying the explosive and the strengthening ingredient such as a polyester fiber or metallic fines (usually a minor amount of from about 0.05 to about 2 weight % and preferably about 0.5 weight % when used), when such a strengthening ingredient is used, with water, then adding an aqueous dispersion of polytetrafluoroethylene, and then coagulating the polytetrafluoroethylene resin by the addition of a water-miscible organic solvent such as acetone, methyl alcohol, and the like. It was heretofore thought that a thermosetting resin such as polytetrafluoroethylene could not be used in admixture with high explosives because of the high temperature (approximately 375° in the case of polytetrafluoroethylene) required to sinter the resin and obtain maximum physical properties. I have found, however, that explosives bound with polytetrafluoroethylene can be processed at a temperature of from about 120° C. to about 125° C. and at a pressure of from about 20,000 psi. to about 30,000 psi. to yield the desired physical properties of density and compressive strength. Such a resin was also thought to be incapable of use in explosive compositions due to the fact that it could not be incorporated therein by the so-called "slurry method" (which is based upon the use of a water-immiscible solvent for the dissolution of the plastic, the solid explosive being slurried with water and the lacquer added to the resulting slurry, with granulation being accomplished by distilling the solvent from the agitated slurry) or the so-called "quench method" (which is based upon the use of a water-miscible solvent for the dissolution of the plastic and as a slurry medium for the solid explosive component, precipitation of the plastic being accomplished by the addition of water or other precipitant to the slurry of lacquer and explosive and granulation being controlled by agitation and water addition). The solubility properties alone prevent the use of either of the foregoing methods, and conventional dry blending fails to produce a satisfactory coating of the resin on the crystalline explosive particles. These conventional methods also do not allow uniform incorporation of the plastic constituent in the composition due to the difficulty in dispersing the explosive. By my method, however, I have found that not only can polytetrafluoroethylene resin be readily dispersed in an explosive molding composition of the PBX type, but the incorporation therein of said polytetrafluoroethylene resin increases the density of the composition as well as imparts thereto increased explosive power. In other words, there is a more efficient use of energy at the particular sensitivity level desired of the composition.

According to my invention, the explosive to be bonded is slurried in water and thoroughly agitated until a substantially homogeneous slurry is obtained. The weight ratio of water to suspended explosive should be about 3 to 1 of water to 1 of explosive, preferably about 2:1. The aqueous dispersion of polytetrafluoroethylene resin is prepared so as to contain from about 25% to about 75% polytetrafluoroethylene resin solids by weight and to have a viscosity of from about 2 to about 20 centipoises at room temperature and a pH of from about 7 to about 12. We have found that best results are obtained when the dispersion contains from about 55% to about 65% polytetrafluoroethylene resin solids by weight and a pH of about 10. Resin particles of an average size of about 0.2 microns can be used. From about 1% to about 10% by weight of the polytetrafluoroethylene resin of a non-ionic wetting agent is ordinarily used as a stabilizer for the polytetrafluoroethylene resin aqueous dispersion. The dispersion of polytetrafluoroethylene resin is added slowly to the slurry and sufficient time allowed for thorough mixing. This is followed by the slow addition to the slurry of the organic solvent. Instead of acetone or methyl alcohol, other suitable solvents such as ethyl alcohol, isopropyl alcohol, n-propyl alcohol and the like can be utilized. The rate of agitation is increased and maintained for several minutes until total precipitation and coagulation has occurred. The slurry is then filtered, generally on a relatively coarse medium filter, and subsequently dried. The molding powder can be preformed by being compacted with rolls. It can also be pressed into pellets. The pellets are formed under about 5 mm Hg vacuum at a preferred temperature of from about 120° to about 125° C. and at a pressure of from about 20,000 psi. to about 30,000 psi.

Although the amount of binding agent to be used depends somewhat upon the particular explosive being coated or bonded and the particular use to be made of the explosive compositions, I have found that the use of at least about 2% by weight of the polytetrafluoroethylene resin produces the desirable properties mentioned hereinabove. A concentration of from about 2% to about 10% by weight is a permissible range, and from about 3% to about 8% by weight is preferred.

My invention is illustrated by the following examples of preferred embodiments thereof. The compositions were prepared at ambient temperature and pressure.

EXAMPLE 1

A composition containing 97% by weight of HMX and 3% by weight of polytetrafluoroethylene resin was prepared as follows: The HMX (0.97 part) was slurried in about twice its weight of water. Polytetrafluoroethylene resin (0.03 part) was dispersed together with about 1.35% of a non-ionic wetting agent based on the weight of the polytetrafluoroethylene resin in sufficient water to make a substantially homogeneous dispersion having a total polytetrafluoroethylene resin solids content of from about 33% to about 35.5% by weight, a pH of about 10, a room temperature viscosity of about 4 centipoises, and a density of from about 2.1 to about 2.3 g/ml. This dispersion was added slowly to the slurry of HMX. About 3 parts by weight of acetone based upon the expected total product weight were then added slowly, and the dispersion was mixed with increased agitation for about two minutes. The thoroughly mixed dispersion was then vacuum filtered and dried. The molding powder which resulted was of a fluffy and tacky texture. It was compacted with rolls in a conventional manner into sheet form. The molding powder was pressed under about 5 mm. Hg vacuum into cylindrical pellets of about ½ inch in diameter and ¾ inch to 1 inch in height at a temperature of from about 120° C. to about 125° C. and at a pressure of from about 20,000 psi. to about 30,000 psi. The density of the pellets produced was from about 97% to about 99% of the theoretical maximum density.

EXAMPLE 2

A composition was prepared in accordance with the procedure in Example 1 with the exception that the aqueous dispersion was prepared in such a way as to contain from about 59% to about 61% polytetrafluoroethylene resin as solids (by weight) and from about 5.5% to about 6.5% of a non-ionic wetting agent (based on the weight of the polytetrafluoroethylene resin) and to have a viscosity at room temperature of about 16 centipoises.

EXAMPLE 3

A composition containing 92% by weight of HMX and 8% by weight of polytetrafluoroethylene resin was prepared in accordance with the procedure of Example 1.

EXAMPLE 4

A composition containing 95% by weight HMX, 4.5% by weight polytetrafluoroethylene resin, and 0.5% by weight polyester resin (polyethylene terephthalate) strengthening fiber was prepared according to the procedure of Example 1. The HMX and the polyester fiber were slurried together with about twice their total weight of water.

EXAMPLE 5

A composition was prepared in accordance with the procedure of Example 1 with the exception that 95% by weight DATB was used in place of the 97% by weight HMX and 5% by weight of polytetrafluoroethylene resin was used in place of the 3% by weight polytetrafluoroethylene resin.

EXAMPLE 6

A composition containing 92% by weight of DATB and 8% by weight polytetrafluoroethylene resin was prepared in the same manner as Example 1 except that a slurry of DATB was used instead of a slurry of HMX.

EXAMPLE 7

A composition containing 92% by weight of DATB, 7.5% by weight polytetrafluoroethylene resin, and 0.5% by weight polyester fiber (polyethylene terephthalate) was prepared according to the procedure of Example 1, except that a slurry of the DATB and the polyester fiber was used instead of a slurry of HMX.

EXAMPLE 8

A composition containing 46% by weight DATB, 46% by weight HMX, and 8% by weight polytetrafluoroethylene resin was prepared according to the procedure of Example 1, with the exception that a slurry of the DATB and HMX was prepared instead of a slurry of HMX only.

EXAMPLE 9

A composition containing 95% by weight RDX and 5% by weight polytetrafluoroethylene resin was prepared according to the procedure of Example 1, the only difference being the use of RDX instead of HMX and the difference in the amount of constituents.

EXAMPLE 10

A composition was prepared as in Example 9, with the exception that it contained 92% by weight RDX and 8% by weight polytetrafluoroethylene resin, and the aqueous dispersion of polytetrafluoroethylene resin was prepared so as to have the properties of the aqueous dispersion of polytetrafluoroethylene resin used in Example 2.

The following two examples, Examples 11 and 12, illustrate the utility of the novel compositions of this invention and their ability to withstand long periods of exposure at a relatively high temperature.

EXAMPLE 11

Explosive molding powder of the composition of Example 1, and prepared in accordance therewith, were pressed into explosive billets or pressed pieces having a size of about 1⅝" in diameter and 2" in height and were boosted with 10 grams of Tetryl (N,2,4,6-tetranitro-H-methylaniline). These billets were detonated with such brisance that a ¼" steel plate was penetrated by the blast.

EXAMPLE 12

The explosive molding compositions of Examples 5 through 7 were exposed at 200° C. for 24 hours. A maximum evolution of approximately 0.2 ml. of gas per gram per hour was observed for these compositions. The compositions of Examples 1, 2, 3, 4, 9 and 10 were exposed at 120° C. for 40 hours. A maximum of 5 ml. of gas per gram of composition were released during this period of exposure.

It can readily be seen from the above description and examples that by my invention I have provided a novel explosive molding composition containing polytetrafluoroethylene resin having a high density, enhanced compressive strength, good machinable and bonding characteristics, excellent high-temperature resistance and good hydrolytic stability, all of the foregoing properties resulting from the incorporation in said composition of the polytetrafluoroethylene resin bonding agent, and a novel method for the preparation of said explosive molding composition.

The invention has been described in detail with particular reference to preferred embodiment thereof, but it will be understood that variations and modifications can be effected within the spirit and scope of the invention as described hereinabove and as defined in the appended claims.

I claim:

1. A method for the preparation of an explosive composition which comprises dispersing with mixing polytetrafluoroethylene resin together with a non-ionic wetting agent in sufficient water to make a substantially homogeneous dispersion containing about 55–65% polytetrafluoroethylene resin solids, adding with mixing the dispersion of said polytetrafluoroethylene resin to a water slurry of a solid explosive capable of being plastic bonded selected from the group consisting of 1,3-diamino-2,4,6-trinitrobenzene, cyclotrimethylenetrinitramine and cyclotetramethylenetetranitramine, slowly adding with agitation to the explosive slurry containing the polytetrafluoroethylene resin a coagulating water-miscible organic solvent selected from the group consisting of methyl alcohol, ethyl alcohol, n-propyl alcohol, isopropyl alcohol and mixtures thereof, and recovering a coagulated bonded explosive, said polytetrafluoroethylene resin amounting to from 2–10% by weight of the explosive composition.

2. The method of claim 1 wherein the solid explosive is 1,3-diamino-2,4,6-trinitrobenzene.

3. A method for the preparation of an explosive molding composition which comprises slurrying in water an explosive selected from the group consisting of 1,3-diamino-2,4,6-trinitrobenzene, cyclotrimethylenetrinitramine and cyclotetramethylenetetranitramine, thoroughly agitating the mixture formed thereby until a substantially homogeneous slurry is obtained, adding to said slurry with mixing an aqueous dispersion of polytetrafluoroethylene resin, slowly adding to the thoroughly mixed slurry an inert water-miscible organic solvent selected from the group consisting of methyl alcohol, ethyl alcohol, n-propyl alcohol, isopropyl alcohol and mixtures thereof, agitating said slurry until substantially complete precipitation of said polytetrafluoroethylene resin has occurred, filtering said slurry, and collecting and drying the resulting product comprising particles of explosive coated with polytetrafluoroethylene resin, said product containing from 2–10% by weight polytetrafluoroethylene resin.

4. The method according to claim 3 wherein the explosive comprises 1,3-diamino-2,4,6-trinitrobenzene.

5. An explosive composition consisting essentially of particulate explosive material comprising cyclotrimethylene trinitramine coated with solid polytetrafluoroethylene in discrete particles of average size of about 0.2 microns and constituting from about 2 to about 10% by weight of the coated particles.

6. An explosive composition as claimed in claim 5 wherein the polytetrafluoroethylene is in the form of a coagulated dispersion.

* * * * *